US008337600B2

(12) United States Patent
Paur et al.

(10) Patent No.: US 8,337,600 B2
(45) Date of Patent: Dec. 25, 2012

(54) ELECTROSTATIC PRECIPITATOR

(75) Inventors: Hanns-Rudolf Paur, Karlsruhe (DE); Andrei Bologa, Stutensee (DE); Klaus Woletz, Eggenstein-Leopoldshafen (DE)

(73) Assignee: Karlsruher Institut Fuer Technologie, Karlsruhe (DE)

( * ) Notice: Subject to any disclaimer, the term of this patent is extended or adjusted under 35 U.S.C. 154(b) by 244 days.

(21) Appl. No.: 12/919,877

(22) PCT Filed: Jan. 14, 2009

(86) PCT No.: PCT/EP2009/000158

§ 371 (c)(1),
(2), (4) Date: Aug. 27, 2010

(87) PCT Pub. No.: WO2009/106192

PCT Pub. Date: Sep. 3, 2009

(65) Prior Publication Data

US 2011/0011265 A1 Jan. 20, 2011

(30) Foreign Application Priority Data

Feb. 29, 2008 (DE) ..... 10 2008 011 949

(51) Int. Cl.
*B03C 3/011* (2006.01)
*B03C 3/70* (2006.01)

(52) U.S. Cl. ..... 96/58; 55/DIG. 38; 96/66; 96/88; 96/96; 96/97; 96/98

(58) Field of Classification Search ..... 96/57, 58, 96/63, 66, 88, 95–100; 95/69, 70, 78; 55/DIG. 38
See application file for complete search history.

(56) References Cited

U.S. PATENT DOCUMENTS

| | | | | |
|---|---|---|---|---|
| 1,605,648 | A * | 11/1926 | Cooke | 95/79 |
| 2,273,194 | A * | 2/1942 | Hedberg et al. | 95/66 |
| 3,740,925 | A | 6/1973 | Gothard | |
| 3,765,154 | A * | 10/1973 | Hardt et al. | 96/88 |
| 3,818,678 | A | 6/1974 | Gothard | |
| 3,979,189 | A * | 9/1976 | Alskog | 96/58 |
| 4,529,418 | A * | 7/1985 | Reif et al. | 96/45 |
| 4,604,112 | A | 8/1986 | Ciliberti et al. | |
| 5,538,692 | A * | 7/1996 | Joannou | 422/121 |
| 6,193,782 | B1 * | 2/2001 | Ray | 95/4 |
| 6,221,136 | B1 | 4/2001 | Liu et al. | |
| 6,508,861 | B1 * | 1/2003 | Ray | 95/79 |
| 6,663,696 | B1 * | 12/2003 | Miller et al. | 96/88 |
| 6,858,064 | B2 * | 2/2005 | Bologa et al. | 95/65 |

(Continued)

FOREIGN PATENT DOCUMENTS

DE 10244051 C1 11/2003

(Continued)

*Primary Examiner* — Richard L Chiesa
(74) *Attorney, Agent, or Firm* — Leydig, Voit & Mayer, Ltd.

(57) ABSTRACT

An electrostatic precipitator for removing solid and liquid components from an aerosol includes a precipitator housing having a raw gas inlet for an aerosol to be cleaned, a clean gas outlet for cleaned aerosol, and at least one aerosol supply channel flange-mounted to the raw gas inlet, a drain device for solid and liquid components that are separated from the aerosol, an ionization stage externally powered via a high-voltage bushing and including at least one metallic high-voltage rod that extends into a flow path of the aerosol and to which high voltage is applyable, and a collector stage disposed in the flow path downstream of the ionization stage.

16 Claims, 6 Drawing Sheets

U.S. PATENT DOCUMENTS

| | | | | |
|---|---|---|---|---|
| 7,101,424 | B2 | 9/2006 | Waescher et al. | |
| 7,270,697 | B2 * | 9/2007 | McAnespie | 96/44 |
| 7,517,394 | B2 | 4/2009 | Bologa et al. | |
| 7,582,144 | B2 | 9/2009 | Krigmont | |
| 7,582,145 | B2 | 9/2009 | Krigmont | |
| 2004/0226449 | A1 * | 11/2004 | Heckel et al. | 96/88 |
| 2008/0302241 | A1 | 12/2008 | Bologa et al. | |

FOREIGN PATENT DOCUMENTS

| | | | | |
|---|---|---|---|---|
| DE | 102004037286 | B3 | | 8/2005 |
| DE | 102005023521 | B3 | | 6/2006 |
| JP | 54-156277 | A | * | 12/1979 |
| JP | 2000001320 | A | | 1/2000 |
| WO | WO 2006125485 | A1 | | 11/2006 |
| WO | WO 2007116131 | A1 | | 10/2007 |

* cited by examiner

ELECTROSTATIC PRECIPITATOR

CROSS-REFERENCE TO RELATED APPLICATIONS

This is a U.S. national phase application under 35 U.S.C. §371 of International Application No. PCT/EP2009/000158, filed Jan. 14, 2009, and claims benefit of priority under 35 U.S.C. §119 of German Application No. DE 10 2008 011 949.0, filed Feb. 29, 2008.

FIELD

The present invention relates to an electrostatic precipitator for removing solid and liquid components from an aerosol.

BACKGROUND

Electrostatic precipitators are effective devices for cleaning fine and ultrafine aerosols. Electrostatic precipitators have several advantages over gas cleaning systems of different technology: They need less energy than mechanical collection systems and have no moving parts; maintenance costs are low and downtimes are reduced.

The design of a compact, highly efficient electrostatic precipitator for droplet aerosols is described in U.S. Pat. No. 6,221,136. This electrostatic precipitator has a high-voltage electrode including multiple wire segments that are positioned within an electrically conductive porous medium and have a central axis along which the electrode assembly extends. The electrode assembly includes a plurality of wire lengths positioned to extend in a direction along the longitudinal axis of the porous medium. The wire segments are arranged to have a substantially longer total length than the length of extension along the longitudinal axis. The particles are passed through the porous medium and across the electrode, and are charged by the high voltage. The porous medium is at a substantially lower voltage than the high-voltage electrode. The flow of the aerosol charged at the electrodes passes through the porous medium to the outlet, in which process the charged particles are precipitated by the porous medium. Electrostatic shields are provided around the high-voltage insulators to reduce the likelihood of contamination of the insulators, which causes current leakage.

Despite this design, this precipitator has several problems. First, when processing sticky aerosols, the electrodes become covered with particles, resulting in a reduction in the efficiency of the precipitator. Second, the insulator is positioned within the collector, where the charged particles are present and form the space charge. A portion of the charged droplets may deposit on the insulator surface under the influence of the space charge, resulting in contamination of the insulator surface. Third, the distance between the electrostatic shields and the housing of the precipitator is small. Therefore, flashovers may occur within the precipitator when the shields become covered with particles. The spark discharges reduce the efficiency of the collector. The porous medium forming the collector performs two functions: First, it is used as a grounded electrode. Second, it collects aerosol particles, which may be in the form of droplets or solid particles. If the filter surface becomes covered with a dielectric fluid, such as lubricating oil, the electric field strength in the electrode system will decrease, reducing the particle charging efficiency.

These problems are substantially eliminated by the measures described in DE 102 44 051 and DE 10 2004 037 286. Document DE 102 44 051 describes an electrostatic precipitator including an ionizer having a plurality of needle- or star-shaped electrodes installed downstream in a grounded nozzle plate. The charged particles are collected in a collector installed downstream of the ionizer (DE 102 44 051 and DE 10 2004 037 286). Due to the small distance between the high-voltage electrode and the grounded electrode in the electrode system, a strong electric field is present in the region of charged particles. Compared to conventional electrostatic precipitators, this makes it possible to operate at high voltages of relatively low magnitude (<20 kV) for charging the particles. The gas stream flows at high velocity through the ionizer and at low velocity through the collector, which is the actual filter. The high velocity of the gas stream in the ionizer stabilizes the operation of the electrostatic precipitator, decreases the influence of the space charge on the charged particles, and reduces corona discharge suppression. The low velocity in the collector improves its efficiency and reduces the pressure drop therein. The grounded electrode in the electrode system and the collector are spatially separated from one another. This reduces clogging of the collector. The grounded grid/mesh electrode or nozzle lets the charged aerosol particles pass therethrough. The electric wind can pass through the mesh electrode without pressure drop. The use of star-shaped electrodes and the high velocity in the electrode region reduces the deposition of sticky particles or droplets on the high-voltage electrodes.

Despite these improvements in the efficiency of the charging and precipitation of particles, the use of an operating high voltage of low magnitude, the operational stability achieved by corona suppression and the avoidance of deposits on the electrode system, the precipitator is relatively voluminous because of the spatial separation of the ionization stage from the collector. The high-voltage insulator is positioned in the raw gas or in the clean gas stream, wherefore additional measures must be taken against contamination.

SUMMARY

Embodiments of the invention provide an electrostatic precipitator for removing solid and liquid components from an aerosol. The electrostatic precipitator includes a precipitator housing having a raw gas inlet for an aerosol to be cleaned, a clean gas outlet for cleaned aerosol, and at least one aerosol supply channel flange-mounted to the raw gas inlet, a drain device for solid and liquid components that are separated from the aerosol, an ionization stage externally powered via a high-voltage bushing and including at least one metallic high-voltage rod that extends into a flow path of the aerosol and to which high voltage is applyable, and a collector stage disposed in the flow path downstream of the ionization stage. The at least one high-voltage rod extends into the gas flow path from a high-voltage insulator disposed outside the flow path in a pot-shaped insulator housing that is not traversed by the aerosol, the insulator housing connected to an electrical reference potential. The high-voltage rod has a high-voltage electrode disposed at a free end of the high-voltage rod and a protective electrode disposed at a distance d from an opening to the insulator housing, the high-voltage and protective electrodes being disk-shaped and including radially oriented tips uniformly distributed around their circumference. The high-voltage rod extends coaxially into a grid or wire mesh electrode comprising a hollow-cylindrical sleeve having perforated sheet metal or a wire mesh, the grid or wire mesh electrode being connected to a reference potential and attached at one end thereof to a bottom plate of the insulator housing so as to form a concentric gap having a minimum width H between each of the high-voltage and protective electrodes and the grid or wire mesh electrode. The grid or wire mesh electrode is at least one of abutting, and being received in a perforated nozzle plate, the perforated nozzle plate being at the electrical reference potential. The grid or wire mesh electrode is circumferentially surrounded by a porous collector over a length not exceeding a length of the hollow-cylindrical sleeve, the aerosol flowing through the porous collector.

BRIEF DESCRIPTION OF THE DRAWINGS

Embodiments of the present invention are described in greater detail with reference to the following figures, in which.

DETAILED DESCRIPTION

Figure 1A:
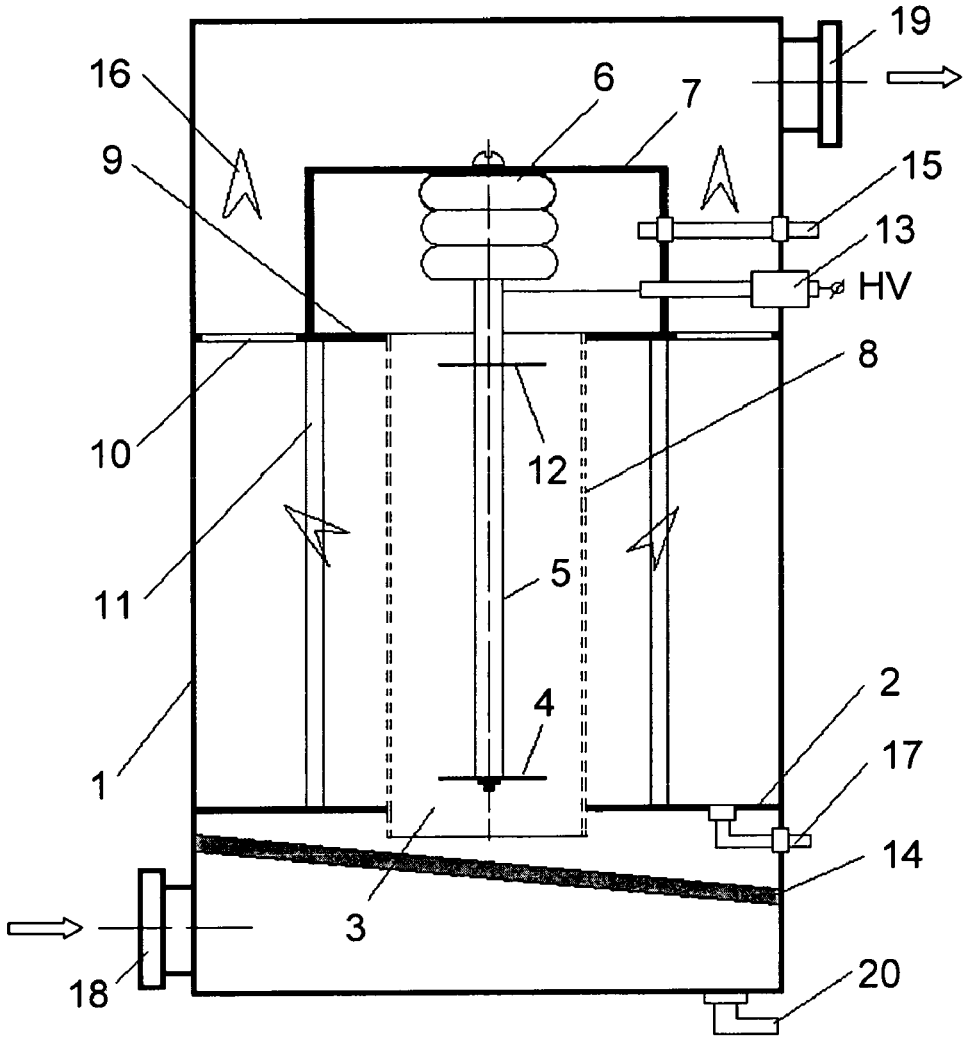
FIG. 1*a* is a longitudinal section through a first embodiment of the electrostatic precipitator.

Embodiments of the present invention provide a compact electrostatic precipitator having high reliability of operation. In addition, the operating high voltage of the precipitator is kept low. Both long-term operational stability and the efficiency of the collector are ensured.

The compact electrostatic precipitator, as is generally known, includes two assemblies, namely an ionization stage followed by a downstream collector, which are accommodated in a precipitator housing.

An embodiment of a precipitator includes a precipitator housing having an inlet, the raw gas inlet, for the aerosol to be cleaned and an outlet, the clean gas outlet, for the cleaned aerosol. At least one aerosol supply channel is flange-mounted to the raw gas inlet. After being freed from the solid and liquid particles, the gas is discharged from the precipitator as clean gas, either directly into the environment, or is passed on through a flange-mounted channel. Typically, a drain device is provided in the collector area of the precipitator to allow discharge of the solid and liquid components that are separated from the aerosol in that area. An ionization stage in the precipitator is externally powered via a high-voltage bushing. The ionization stage includes at least one metallic rod which is equipped with radially serrated electrode disks and extends into the flow path of the aerosol, and to which high voltage can be applied, and in which the solid and liquid particles in the passing gas stream are electrically charged by means of corona discharges. The precipitator contains a collection device which is disposed downstream of the ionizer and in which the solid and liquid particles in the gas stream are precipitated.

A further embodiment of the electrostatic precipitator has at least one metallic high-voltage rod which is fixed at one end in an insulator located outside the flow path of the aerosol and extends therefrom into said flow path. The high-voltage insulator is located and exposed in a pot-like housing which is not traversed by the aerosol stream. This insulator housing is connected to an electrical reference potential, typically ground potential. The high-voltage rod is equipped with a disk-shaped electrode (the high-voltage electrode) at least in the region of its free end, and with another disk-shaped electrode (the protective electrode) disposed outside of the insulator housing at a distance d from the opening in the bottom plate. The protective electrode is situated at the edge or outside the gas stream. The high-voltage electrode(s) and the protective electrode have radially oriented tips which are uniformly distributed around their circumference and have the minimum distance H from the surrounding hollow-cylindrical sleeve, which is made of perforated sheet metal or wire mesh and constitutes the grid or wire mesh electrode. The high-voltage rod extends coaxially into the grid or wire mesh electrode, which is form-fittingly seated at a first end portion in the opening to the insulator housing and is connected to the reference potential, typically ground potential. At several points uniformly distributed around the circumference of the high-voltage electrode(s) and the protective electrode, the gap from the surrounding grid or wire mesh electrode has the minimum width H.

The grid or wire mesh electrode is seated at its second end portion in a nozzle in the plate, the nozzle plate, which is at the electrical reference potential, or abuts at its second end face a gas-impermeable plate, the end plate. Thus, the grid or wire mesh electrode(s) is/are positioned in the flow path of the aerosol.

The grid or wire mesh electrode(s) is/are completely surrounded by a porous collector over a length no greater than the longitudinal dimension thereof, said collector being at the electrical reference potential. As a result, the aerosol stream must always flow entirely through the porous collector.

According to an embodiment, the insulator housing is provided with a high-voltage bushing through which the high-voltage rod or rods is/are externally connected to a high-voltage electrical potential. Depending on the design of the precipitator (see below), the high-voltage bushing extends to the exterior either directly or additionally also through the precipitator housing. In one embodiment, the insulator housing is further provided with a tubular port through which a clean gas may be introduced under pressure into the interior of the insulator housing so as to create a positive pressure therein, said positive pressure being at least slightly above the pressure in the housing of the precipitator. This alone would prevent ingress of the aerosol to be processed. The inflow of the clean gas or pure air through this tubular port may, in addition, occur at a predetermined temperature, preferably at a temperature higher than that in the space between the electrode-carrying high-voltage rod and the grid or wire mesh electrode. The resulting temperature gradient from the insulator housing to the precipitator housing would contribute to suppressing ingress of aerosol.

The housing of the high-voltage insulator is disposed concentrically on the bottom plate extending across the clear cross-sectional area of the precipitator housing. The high-voltage insulator is disposed in the insulator housing and has one end exposed therein. The high-voltage rod is inserted at one end portion in the exposed end of the high-voltage insulator. The grid or mesh electrode, at one end portion, begins at and extends from the central passage formed in the bottom plate. The other end portion of the grid or mesh electrode extends through the nozzle in the nozzle plate extending across the clear cross-sectional area of the precipitator housing. According to an embodiment, the bottom plate is permeable to the gas stream in the region between the insulator housing and the wall of the precipitator housing. In this embodiment, the precipitator housing covers the bottom plate and the insulator housing disposed centrally thereon.

The electrostatic precipitator according to yet another embodiment includes a pre-filter upstream of the nozzle plate, said pre-filter extending across the clear cross-sectional area of the housing at an angle to the axis of the precipitator and with its lowermost portion close to a drain pipe in the precipitator housing so as to preferably direct the flow of draining liquid to said drain pipe. On the same side of the pre-filter, but opposite the drain pipe, a raw gas inlet flange is provided in the end face or in the circumferential shell of the precipitator on the upstream side for attachment of the aerosol supply channel. In the wall of the precipitator that covers the insulator housing and the bottom plate, another flange is provided in the end face or in the circumferential shell to provide an outlet for the clean gas.

In a different embodiment, the bottom plate is not permeable in the region between the insulator housing and the wall of the precipitator housing. The bottom plate and the insulator housing disposed centrally thereon cover the precipitator.

According to one embodiment, the pre-filter is located upstream of the free end face of the grid or mesh electrode and the nozzle plate and extends across the clear cross-sectional area of the housing at an angle to the axis of the rod. The raw gas inlet flange is provided in the precipitator housing wall either in the end face, or preferably in the circumferential shell, because here the drain cock is located in the end face of the precipitator wall. In this embodiment, the clean gas outlet flange is located in the portion of the precipitator wall between the bottom plate and the nozzle plate.

In another embodiment of the electrostatic precipitator, the insulator housing is also disposed on a bottom plate extending across the clear cross-sectional area of the precipitator housing, but the high-voltage insulator is placed with one end centrally on the bottom plate. The end of the high-voltage insulator extending into the insulator housing has mounted thereon a high-voltage grid to which the high-voltage rods are attached in such a way that they are uniformly distributed around the precipitator axis and equally radially spaced therefrom, and each extend coaxially into their respective grid or mesh electrodes.

The bottom plate is permeable in the region between the insulator housing and the wall of the precipitator housing. In an embodiment, pre-filter is located upstream of the grid or mesh electrodes and the nozzle plate and extends across the clear cross-sectional area of the housing at an angle to the axis of the precipitator.

A plate, the fixing plate, is attached via fastening elements to the bottom plate centrally outside of the insulator housing so as to ensure positional stability, especially during gas flow, the grid- or mesh electrodes form-fittingly extending through said fixing plate.

In yet another embodiment, the insulator housing is disposed concentrically on a bottom plate extending across the clear cross-sectional area of the precipitator housing. The high-voltage insulator is centrally mounted within the insulator housing to the bottom at the end face thereof. The high-voltage rod is inserted at one end portion in the high-voltage insulator. The grid or mesh electrode, at one end portion, begins at and extends from the central passage formed in the bottom plate and abuts at its other end face the centrally disposed, gas-impermeable plate and is completely covered by it. The nozzle plate is located between the bottom plate and the end plate. The collector is disposed between the nozzle plate and the end plate and completely surrounds the sleeve.

According an embodiment, the raw gas inlet is disposed in the bottom plate or in the portion of the precipitator wall between the bottom plate and the nozzle plate. The clean gas outlet is located in the portion of the precipitator wall that covers the collector.

In yet another embodiment of the electrostatic precipitator, the insulator housing is disposed concentrically on the bottom plate which extends across the clear cross-sectional area of the precipitator housing. The high-voltage insulator is centrally mounted within the insulator housing to the bottom at the end face thereof. The end of the high-voltage insulator extending into the insulator housing has mounted thereon a high-voltage grid to which the rods are attached in such a way that they are uniformly distributed around the precipitator axis and equally radially spaced therefrom, and each extend coaxially into their respective grid or mesh electrodes. The grid or mesh electrodes held in the bottom plate abut at their other end faces the covering end plate. The grid or mesh electrodes extend form-fittingly through the nozzle plate between the bottom plate and the end plate. The system of grid or mesh electrodes is completely surrounded by the porous collector between the nozzle plate and the end plate.

According to an embodiment, the raw gas inlet is disposed in the bottom plate or in the circumferential shell of the precipitator between the bottom plate and the nozzle plate. The clean gas outlet is disposed in the portion of the precipitator housing wall within which the porous collector is exposed.

The advantages of the electrostatic precipitator are as follows:

- aerosols with particle concentrations >1 g/Nm$^3$ can be processed efficiently, both technically and economically*;
- the precipitator has a compact, space-saving design
- the precipitator has a long service life;
- low maintenance costs due to low contamination of the high-voltage insulator;
- improved particle charging due to the grounded grid or wire mesh electrode;
- increased particle deposition due to the space-charge effects between the grid or wire mesh electrode and the porous collector;
- increased operating time of the collector between two cleaning cycles;
- rugged high-voltage electrodes;
- modular, single or multiple nozzle design;
- use of a grid or wire mesh electrode as a pre-filter.

(*Note: g/Nm$^3$ denotes grams per standard cubic meter and, in fact, N signifies the standard here of, namely, 0° C. and 1 at.)

Figure 1B:
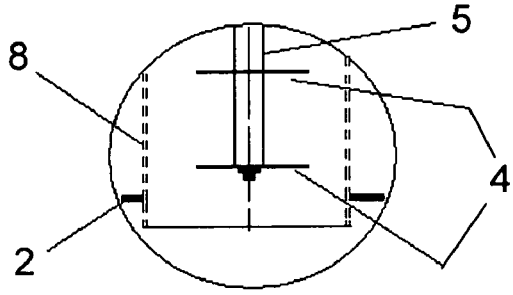
FIG. 1*b* is a view showing a plurality of high-voltage electrodes on the high-voltage rod.

The electrostatic precipitator proposed in FIG. 1 has its raw gas inlet 18 in the lower region in the circumferential shell of precipitator housing 1. Grounded nozzle plate 2 is mounted within the precipitator housing and has a nozzle 3 provided centrally therein. A grounded grid electrode 8 is form-fittingly seated in the nozzle and extends here slightly beyond nozzle plate 2 on the upstream side. A disk-shaped high-voltage electrode 4 having radially oriented tips is mounted on the free end of high-voltage rod 5. High-voltage electrode 4 may be configured in different ways, as can be seen, for example, from DE 10 2005 023 521. This electrode may be needle-shaped, disk-shaped, or shaped like a star washer. High-voltage electrode 4 is positioned within grid electrode 8 in such a way that the circumferential tips/serrations have the minimum distance H from grid electrode 8.

Porous collector 11 (porous filter 11) is used to collect the solid and liquid aerosol particles. Here, grid electrode 8 and the collector are mounted within precipitator housing 1 between bottom plate 9 and nozzle plate 2. High-voltage rod 5 is fixed at one end in high-voltage insulator 6, which is centrally attached to the bottom of insulator housing 7 and exposed toward the interior thereof. High-voltage insulator 6 is exposed within the insulator housing 7, and thus is not located in the raw gas stream. High-voltage rod 5 is connected to the high-voltage terminal of a high-voltage power supply (not shown here) via high-voltage bushing 13.

In addition, a high-voltage electrode 12 is mounted on high-voltage rod 5 close to and before the opening to insulator housing 7. This high-voltage electrode has a similar or identical shape as high-voltage electrode 4 at the free end of high-voltage rod 5. The assembly formed by high-voltage electrodes 4, 12 and high-voltage rod 5 is coaxial with grid electrode 8.

Bottom plate 9 has passages 10 allowing the gas stream to pass therethrough unhindered, or at least substantially so. Porous collector 11 surrounds grid electrode 8 completely and concentrically at a distance therefrom. As a result of this configuration, the entire gas stream is positively passed through the porous collector.

The electrostatic precipitator is provided with flange-type raw gas inlet 18 for the entry of gas stream 16, which is supplied through a channel. After passing through the porous collector 11, the cleaned gas stream is discharged at the downstream end through clean gas outlet port 19 into the open air, or is passed on through a flange-mounted channel. In the figures, arrows 16 indicate the flow path through the precipitator.

The electrostatic precipitator further has a pipe 15 extending through wall 1 of the precipitator and the wall of insulator housing 7, allowing clean air or clean gas to be introduced therethrough into insulator housing 7 so as to prevent high-voltage insulator 6 from being contaminated by deposits. The attached clean-air or clean-gas reservoir is not shown in the drawing. Optionally, the clean air or clean gas may also be introduced in a heated state.

The electrostatic precipitator has a pre-filter 14, which is mounted within precipitator housing 1 upstream of nozzle plate 2, here in an inclined position. This pre-filter is intended to trap larger particles in the raw gas stream and, more specifically, particles of a size large enough to prevent them from freely passing through the perforations/meshes of grid or wire mesh electrode 8 because of their diameter.

Furthermore, the precipitator has a pipe 17 which extends away from nozzle plate 2 to the exterior through precipitator wall 1 and through which contaminated liquid that runs off the porous collector 11 and collects on nozzle plate 2 can be discharged. Moreover, the precipitator has a pipe 20 attached to the bottom of precipitator housing 1 to also allow discharge of contaminated liquid which drips off pre-filter 14.

Figure 2A:
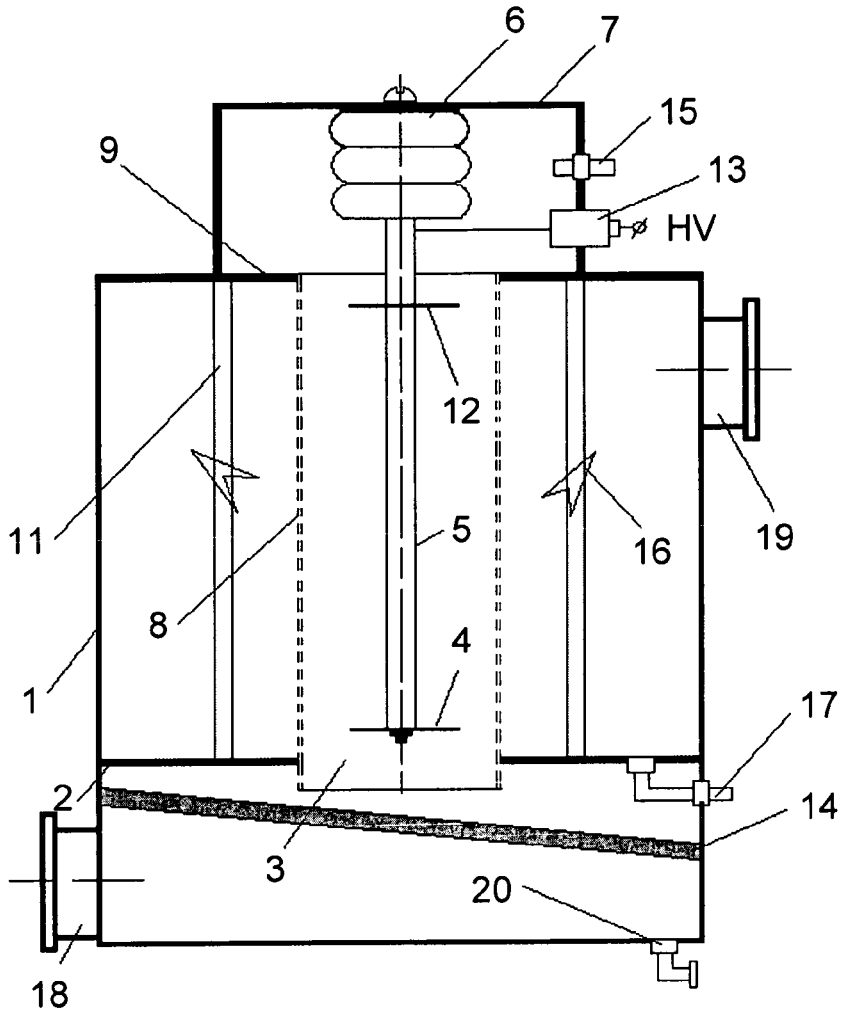
FIG. 2*a* is a longitudinal section through a second embodiment of the electrostatic precipitator.

Insulator housing 7 may be installed within the precipitator on the clean gas side, as is shown in FIG. 1. Alternatively, it may be located outside of the precipitator, in which case bottom plate 9 would not have any openings 10 for the passage of clean gas, as is shown in FIG. 2.

In an electrostatic precipitator, a plurality of high-voltage electrodes 4 may be mounted on high-voltage rod 5. The geometry and size of high-voltage electrodes 4, their position, and the width H of the electrode gap are governed by the conditions under which the precipitator is intended to operate.

Figure 2B:
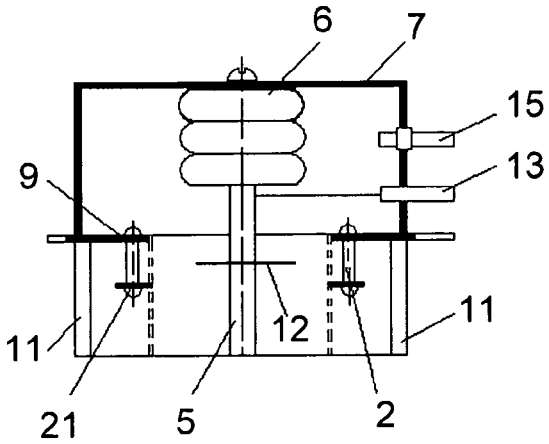
FIG. 2*b* is a view illustrating the attachment of the fixing plate.
Figure 2C:
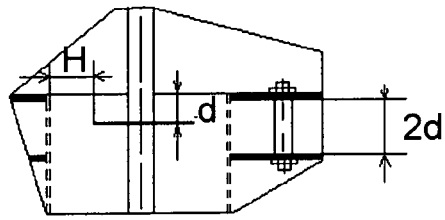
FIG. 2*c* is a view showing the spacing of the high-voltage electrode that is closest to the bottom plate.

In order to ensure mechanical stability and a defined position, fixing plate 21 is mounted between bottom plate 9 and nozzle plate 2 (see FIG. 2*b*). The distance between bottom plate 9 and fixing plate 21 is 2d (see FIG. 2*c*), where d is the distance between additional high-voltage electrode 12 and bottom plate 9, with d=0.5 . . . 1.5 H and H being the width of the gap between the gap-forming electrodes. Fixing plate 21 has an opening or aperture, the grid electrode form-fittingly extending therethrough. Fixing plate 21 is attached to the bottom plate via fixing elements or spacing elements 22. Fixing plate 21 and porous collector 11 (collector filter 11) are spaced apart.

Figure 6:
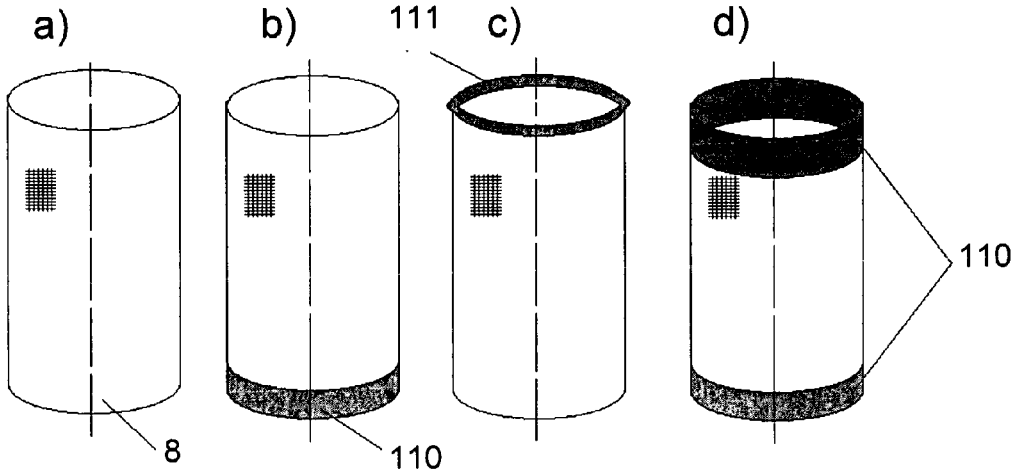
FIGS. 6*a* through *d* are views showing variants of the grid or wire mesh electrode.

Grid or wire mesh electrode 8 may have an open end face (FIG. 6*a*) or a shielded end face 110, 111. The term "open" as used herein is intended to mean that the end face has sharp or pointed portions; i.e. freely extending cut wire ends. As a result, corona discharges of opposite polarity may occur at said locations, the polarity of said corona discharges being opposite to that of the desired corona discharge between electrodes 11 and 4 or 12, respectively. The term "shielded end face 110, 111" is intended to mean that the end face is smooth, i.e., pointed tips or sharp edges are avoided so as to prevent the occurrence of corona discharges of opposite polarity. To this end, the end face edges shown in FIGS. 6*b*, 6*d* are covered by a dielectric or metallic ring 110, 111.

Figure 7:
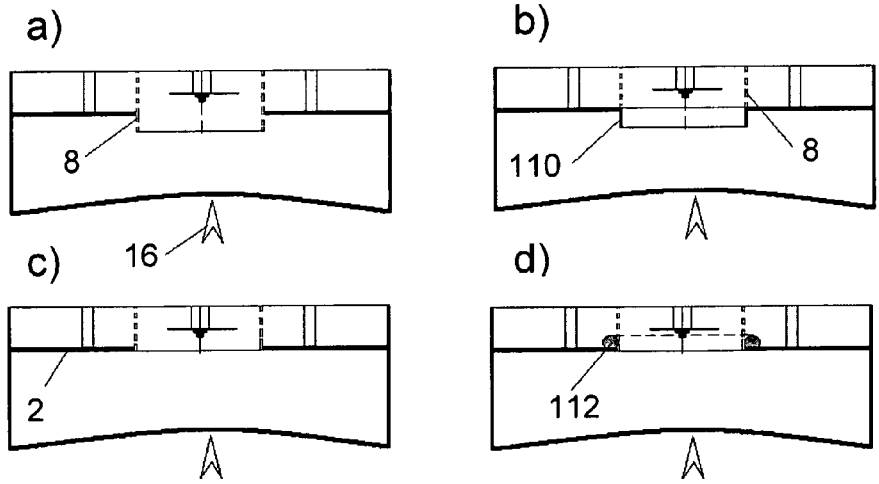
FIGS. 7*a* through *d* illustrate the installation of the grid or wire mesh electrode in the nozzle plate.
Figure 8:
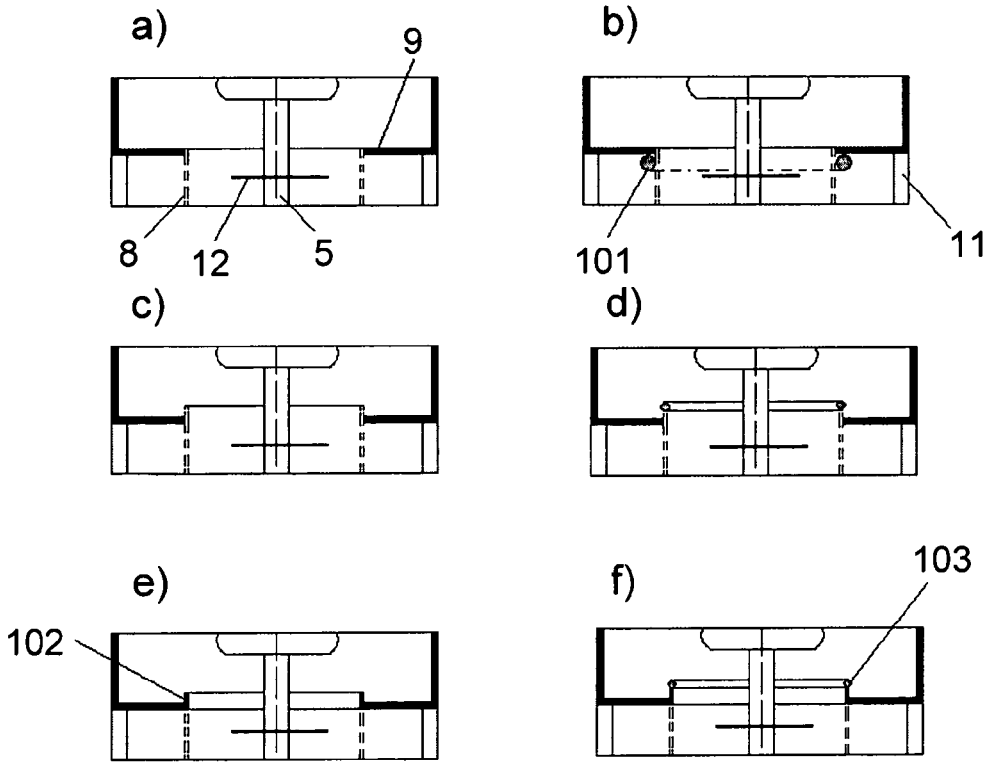
FIGS. 8*a* through *f* illustrate the installation of the grid or wire mesh electrode in the bottom plate.

Grid or wire mesh electrode 8 may be inserted in nozzle 3 in such a way that the entry through the exposed open end face of grid or wire mesh electrode 8 is upstream of nozzle plate 2 (FIG. 7*a*), or such that shielded end face edge 110 terminates upstream of nozzle 3 (FIG. 7*b*), or that the open end face edge terminates in nozzle 3 (FIG. 7*c*), or that the open end face edge terminates in a fixing ring 112 downstream of nozzle 3 (FIG. 7*d*). The direction of flow of the gas stream to be cleaned is indicated by arrow 16 in each of FIGS. 7*a* through *d*.

In the compact electrostatic precipitator, grid or wire mesh electrode 8 is mounted in the passages of bottom plate 9 in the region of insulator housing 7 in such a way that the free end face edge of grid or wire mesh electrode 8 is located at the level of bottom plate 9 (FIGS. 8*a, b*) or extends into insulator housing 7 (FIGS. 8*c* through *f*). According to FIG. 8*a*, the free end face of grid or wire mesh electrode 8 terminates in the passage in the bottom plate, while according to FIG. 8*b*, a ring 101 is disposed on bottom plate 9 and surrounds grid or wire mesh electrode 8. According to FIG. 8*c*, the free edge of the end face of grid or wire mesh electrode 8 terminates in the insulator housing, and according to FIG. 8*d*, said edge is terminated by a ring. According to FIG. 8*e*, the end face edge of grid or wire mesh electrode 8 is terminated by a dielectric ring 110 extending into the insulator housing. According to FIG. 8*f*, an additional ring is mounted thereon.

Figure 9:
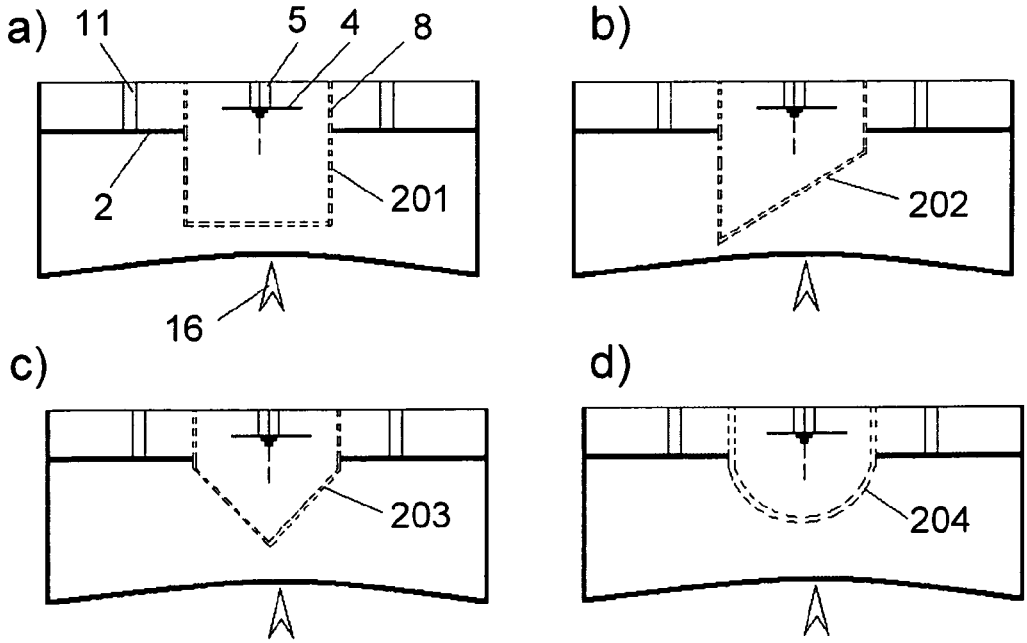
FIGS. 9*a* through *d* show the termination of the grid or wire mesh electrode at the nozzle plate.

The gas stream entry into grid or wire mesh electrode 8 may be covered by screening means, as is shown by way of example in FIGS. 9*a* through *d* and, more specifically, by a planar flat mesh according to FIG. 9*a*, a planar mesh extending at an angle with respect to the entry face of grid or wire mesh electrode 8 (FIG. 9*b*), a conical mesh as shown in FIG.

9*c*, or by a hemispherical mesh, as is shown in FIG. 9*d*. In this manner, particles above a certain size which corresponds to the aperture size of the mesh can be reliably prevented from entering the interior of grid or wire mesh electrode 8 and impairing the same.

Figure 3:
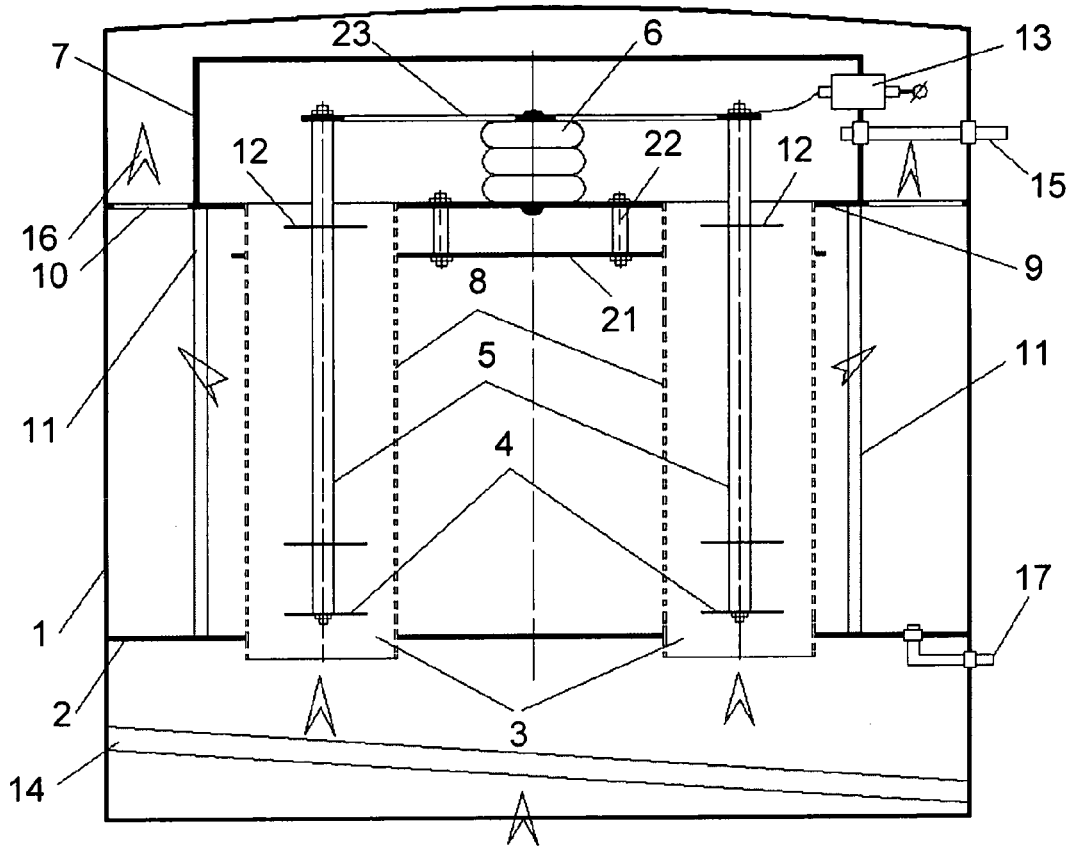
FIG. 3 is a longitudinal section through a third embodiment of the electrostatic precipitator.

FIG. 3 shows a compact electrostatic precipitator having more than one grid or wire mesh electrode 8. More specifically, said precipitator has two grid or wire mesh electrodes 8. This precipitator also includes a housing 1 and a nozzle plate 2, which here has two nozzles 3. The two grid or wire mesh electrodes 8 extend from nozzle plate 2 to bottom plate 9, and are form-fittingly held in their respective nozzles 3 or openings in bottom plate 9. High-voltage insulator 6 is also located outside the gas stream, but is here attached to bottom plate 9 and exposed within the insulator housing. High-voltage insulator 6 has a high-voltage grid 23 centrally mounted on its exposed end, the two high-voltage rods 5 extending coaxially from said high-voltage grid into their respective grid or wire mesh electrodes 8. High-voltage grid 23 is connected to high-voltage bushing 13. The interior of insulator housing 7 can be purged with clean gas or clean air at a desired temperature and pressure via pipe 15. Similarly to FIG. 1, FIG. 3 illustrates the installation of porous collector 11 around the two grid or wire mesh electrodes 8 and between the bottom and nozzle plates, as a result of which there is only one flow path for the gas stream into and through the two grid or wire mesh electrodes 8 and through porous collector 11, as indicated by arrows 16. Likewise, a pre-filter 14 is mounted upstream of nozzle plate 2 in inclined relationship with respect thereto in order to trap coarse particles. Particle-containing liquid that runs off the porous collector and collects on nozzle plate 2 can be discharged through outlet 17. The two high-voltage rods 5 are also coaxially equipped with high-voltage electrodes 4, 12 within grid or wire mesh electrodes 8. To ensure positional stability of the two grid or wire mesh electrodes 8, fixing plate 21 is attached from below to bottom plate 9 via spacing elements 22. The two grid or wire mesh electrodes 8 extend form-fittingly through said fixing plate. The raw gas stream enters the precipitator from below at the end face thereof, as indicated by arrow 16.

The configuration shown in FIG. 3 is exemplary. The variant of mounting the raw gas inlet and the high-voltage insulator according to FIG. 1 could also be implemented without extra effort. What is essential is to create a positive flow path for the gas stream, as indicated by arrows 16, regardless of whether it splits into two during passage through the region of the ionization stage.

Figure 4:
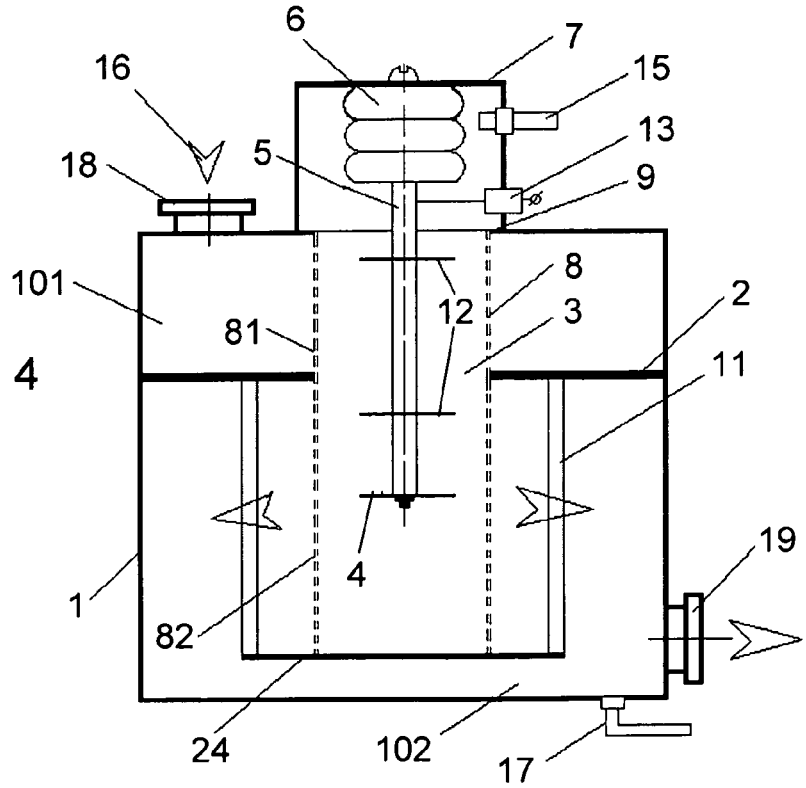
FIG. 4 is a longitudinal section through a fourth embodiment of the electrostatic precipitator.
Figure 5A:
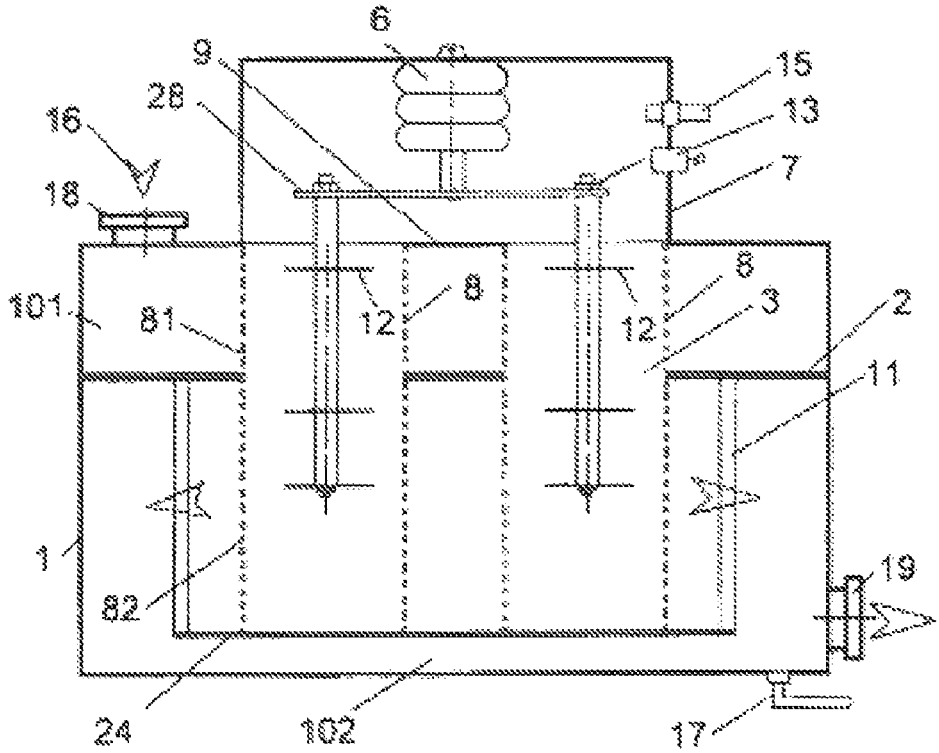
FIG. 5*a* is a longitudinal section through a fifth embodiment of the electrostatic precipitator.
Figure 5B:
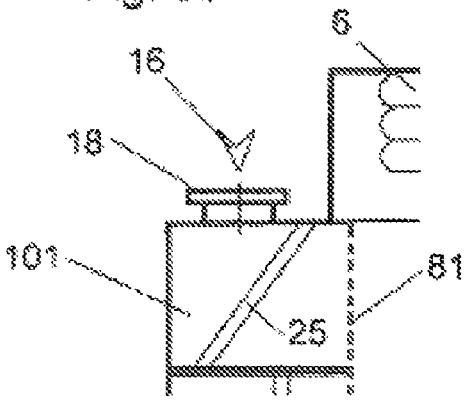
FIG. 5*b* is a view of a pre-filter for the precipitators shown in FIGS. 4 and 5.
Figure 5C:
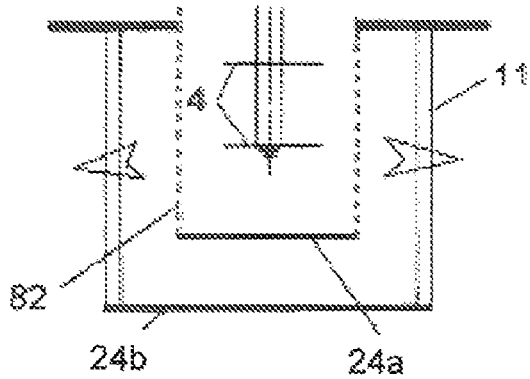
FIG. 5*c* is a view showing a collector modification pertaining to FIGS. 4 and 5*a;*
Figure 5D:
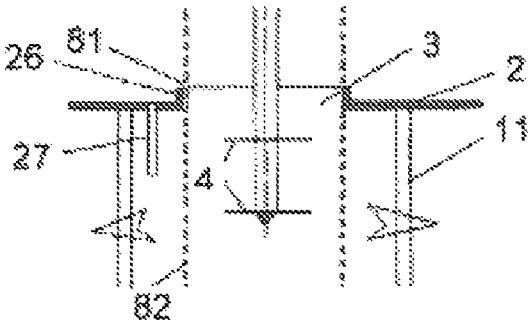
FIG. 5*d* is a view showing a collector modification pertaining to FIGS. 4 and 5*a;*
Figure 5E:
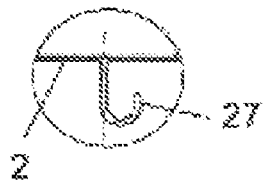
FIG. 5*e* is a view depicting the means for draining liquid from the nozzle plate.

Similarly to FIG. 2, FIG. 4 shows by way of example a compact electrostatic precipitator, where the insulator housing 7 is located on precipitator housing 1, not inside of it (FIG. 1). This precipitator has an ionization stage that includes only one grid or wire mesh electrode 8. The high-voltage rod 5 equipped with high-voltage electrodes 4, 12 projects from the high-voltage insulator attached to the bottom of the insulator housing and extends coaxially into said grid or wire mesh electrode. The interior of insulator housing 7 can also be purged with clean gas or air via pipe 15 through housing wall 7. High-voltage rod 5 is electrically connected to high-voltage bushing 13. Grid or wire mesh electrode 8 is form-fittingly seated at one end face in the opening of the bottom plate within insulator housing 7 and abuts at its other end face the gas-impermeable end plate 24. In this manner, grid or wire mesh electrode 8 is held in a defined position. Here, too, the porous collector completely surrounds grid or wire mesh electrode 8, but not over its entire length, but only over a part thereof. Nozzle plate 2 is located in an intermediate region of the longitudinal extent of grid or wire mesh electrode 8, the grid or wire mesh electrode form-fittingly extending therethrough. In this embodiment, porous collector 11 is disposed between nozzle plate 2 and end plate 24. Raw gas inlet 18 is located in bottom plate 9, while clean gas outlet 19 is provided in the circumferential shell of precipitator housing 1. In this manner, only one positive flow path is created for the gas stream, as indicated by arrows 16. Here, the ionization stage formed by the coaxial electrode system is divided into two areas, namely a gas entry region 81 above the collector area and a gas exit region 82 in the collector area. In this embodiment, contaminant-containing liquid which drips off the collector collects on the bottom of precipitator housing 1, but can also be discharged through the cock 17 mounted in the housing wall. The installation of a pre-filter is not exemplified in this figure, but can be seen in FIG. 5*b*.

FIG. 5 shows another exemplary configuration of the compact electrostatic precipitator. As already explained with reference to FIG. 3, this precipitator has more than one, namely two nozzles. Similarly to FIG. 4, insulator housing 7 is disposed outside of precipitator housing 1. The high-voltage insulator 6 is attached to the bottom of the insulator housing. High-voltage grid 28 is mounted on the free end face of the high-voltage insulator and exposed within the insulator housing. The two high-voltage rods 5 are suspended from high-voltage grid 28 and extend through bottom plate 9 and coaxially into the two grid or wire mesh electrodes 8. High-voltage grid 28 is electrically connected to high-voltage bushing 13. The interior of the insulator housing can be purged with clean gas or air at a desired temperature and/or pressure via pipe 15 through the wall of the insulator housing. The two high-voltage rods 5 are identically equipped with high-voltage electrodes 4, 12 in the area of the two grid or wire mesh electrodes 8. The two grid or wire mesh electrodes 8 abut the gas-impermeable end plate 24 where they are fixed. At their other end faces, the two grid or wire mesh electrodes 8 are form-fittingly seated in their respective openings to the interior of insulator housing 7, which are formed in bottom plate 9. In this embodiment, nozzle plate 2 is located in a region of the longitudinal extent of the two grid or wire mesh electrodes 8, the grid- or wire mesh electrodes form-fittingly extending through their respective nozzles 3 through said nozzle plate. In this manner, the two grid or wire mesh electrodes 8 are additionally held in place. Porous collector 11 is clamped between end plate 24 and nozzle plate 2 and completely surrounds the two grid or wire mesh electrodes 8 in the region therebetween. Raw gas inlet 18 is located in bottom plate 9 in the outer region, while clean gas outlet 19 is provided in the circumferential shell of precipitator housing 1 near the bottom. Here, similarly to FIG. 4, two regions of gas flow are created for the two grid or wire mesh electrodes 8 of the ionization stage, namely a gas stream entry region 81 leading into them and a gas exit region 82 leading out of them. Here, too, the gas stream through the ionizer is split into two branches. Further, the gas stream is positively passed through the precipitator, so that it flows from raw gas inlet 18 to clean gas outlet 19 entirely and solely through the ionizer and the collector, as indicated by arrows 16. As mentioned with respect to FIG. 4, FIG. 5*b* shows by way of example a pre-filter 25 which may optionally be installed to separate large particles.

As indicated in FIGS. 4 and 5, porous collector 11 is clamped between nozzle plate 2 and end plate 24. This configuration may be modified without interfering with the positive flow path provided for the gas stream and in such a way that grid or wire mesh electrode(s) 8 terminate(s) at and flush with the end plate or plates 24*a* at an end face, but porous collector 11 is clamped between nozzle plate 2 and a collector plate 24*b*, gas exit region 82 freely extending into the collector area, as shown in the detail view of FIG. 5*c* for one grid or wire mesh electrode 8.

In the structure of the electrostatic precipitator according to FIGS. 4 and 5, nozzle plate 2 may be surrounded on the upstream side with a ring at its nozzle 3/its nozzles 3, said ring allowing contaminated liquid to be precipitated and collected from the gas stream, while preventing the liquid from running down on grid or wire mesh electrode 8 and contaminating the same or clogging the perforations/meshes. Via a tube 27 through nozzle plate 2, either upstream of downstream of porous collector 11, this contaminated liquid can run off in a controlled manner into a region of the precipitator that is intended for this purpose. In the detail view of FIG. 5*d*, this tube is located in an upstream position, and in FIG. 5*e*, it is illustrated more specifically as a U-shaped pipe 27. Advantageously, the inlet of this pipe 27 is located upstream of an optionally installed pre-filter 25.

The principle of operation of the compact electrostatic precipitator and the positive flow path provided for the gas stream therein is as follows:

Raw gas is introduced via a channel flange-mounted to the precipitator and flows through the pre-filter to separate and collect coarse particles and remove them from the precipitator. After passing through the pre-filter, the particles remaining in the gas stream are able to freely pass through the mesh apertures of grid or wire mesh electrode 8. The gas stream then enters the nozzle and passes through the electrode gap between the high-voltage rod provided with coaxial high-voltage electrodes and the coaxially surrounding grid or wire mesh electrode 8. Application of a high voltage to the high-voltage rod causes a corona discharge at the sharp edges/tips of the high-voltage electrodes. There, the particles entrained in the gas stream are electrically charged and move toward the grid or wire mesh electrode. The particles move under the influence of the gas-dynamic forces and the electrical field in the electrode gap. A portion of the particles is deposited in the grid or wire mesh electrode. The liquid collected there is electrically neutralized because of the reference/ground potential of the grid or wire mesh electrode, runs down on it, drips off into the precipitator, and is drained off therefrom as needed. The other portion passes through the mesh apertures of the grid or wire mesh electrode 8, creating a space charge region between the grid or wire mesh electrode and the porous collector. Under the influence of the space charge and the electrostatic forces between the charged particles and the grounded surfaces of the grid or wire mesh electrode, nozzle plate, bottom plate and porous collector, the charged particles collect on the grounded surfaces and are electrically neutralized. The particle-containing liquid runs off, is collected in the region provided for this purpose in the precipitator, and is drained off as needed.

A portion of the particles enters the space downstream of the high-voltage electrode where they are converted into electrically charged particles under the influence of the electric field between the high-voltage rod and the grid or wire mesh electrode. This electric field drives the charged particles toward the grid or wire mesh electrode where a portion thereof is collected and another portion passes therethrough and into the space between the grid or wire mesh electrode and the porous collector. A small portion of the charged particles reaches the upper zone of the grid or wire mesh electrode where the additional high-voltage electrode is disposed in proximity to the bottom plate. Application of high voltage to the high-voltage rod produces a high electric field between this additional high-voltage electrode and the grid or wire mesh electrode. The corona discharge at the additional high-voltage electrode creates an electric wind which is directed toward the grid or wire mesh electrode. The geometry of the electrode gap is selected such that the velocity of the electric wind is equal to or higher than that of the gas flow in the upper portion of the grid or wire mesh electrode. Under these conditions, the electric wind protects the high-voltage insulator in the insulator housing, just as does the clean gas or the clean air introduced into the interior of the insulator housing. This prevents the charged particles from entering the interior of the insulator housing.

There are also particles which deposit on fixing plate 21 because the fixing plate is also connected to the reference or ground potential, and thus reduces the number of particles that are capable of flying to the insulator housing. The fixing plate is mounted at a distance 2*d* from the passage in the bottom plate, which allows the electric wind to pass at maximum velocity through the grid or wire mesh electrode in the electrode gap formed by the bottom plate and the fixing plate, as a result which the charged particles are blown away. This situation applies to the two cases where the gas flow path through the entire grid or wire mesh electrode is in one direction only (FIGS. 1, 2 and 3) or in opposite directions in some regions (FIGS. 4 and 5).

The porous collector can be made of porous materials of different thickness and density. It can be made of materials of different porosity, which may be dielectric, electrically semi-conductive or conductive. Moreover, the porous material or the grid or wire mesh electrode may contain catalytic additives. The materials must be inert to the process, or at least substantially so.

The dimensions and operation of the compact electrostatic pilot plant are, for example, as follows:

The inside diameter of the nozzle is 50 mm; the outside diameter of the grid or wire mesh electrode is D=50/48 mm; the electrode gap is 13 mm; the two high-voltage electrodes used are disk-shaped electrodes having 7 serrations; the high voltage is a negative polarity DC voltage between 12 and 20 kV; the corona current is between 0.5 and 1 mA; the gas throughput is 30 $m^3$/h; the aerosol processed was an oil-mist aerosol having a particle mass concentration between 100 and 1500 mg/$Nm^3$, a particle size <2 μm and an average particle size of from 0.3 to 0.4 μm.

The collection efficiency is between 92 and 95% for a single-module compact electrostatic precipitator and between 97 and 99% for one having two modules.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An electrostatic precipitator for removing solid and liquid components from an aerosol, comprising:

a precipitator housing having a raw gas inlet for an aerosol to be cleaned, a clean gas outlet for cleaned aerosol, and at least one aerosol supply channel flange-mounted to the raw gas inlet;

a drain device for solid and liquid components that are separated from the aerosol;

an ionization stage externally powered via a high-voltage bushing and including at least one metallic high-voltage rod that extends into a flow path of the aerosol and to which high voltage is applyable; and a collector stage disposed in the flow path downstream of the ionization stage; wherein:

the at least one high-voltage rod extends into the gas flow path from a high-voltage insulator disposed outside the flow path in a pot-shaped insulator housing that is not traversed by the aerosol, the insulator housing connected to an electrical reference potential;

the high-voltage rod has a high-voltage electrode disposed at a free end of the high-voltage rod and a protective electrode disposed at a distance d from an opening to the insulator housing, the high-voltage and protective electrodes being disk-shaped and including radially oriented tips uniformly distributed around their circumference;

the high-voltage rod extends coaxially into a grid or wire mesh electrode comprising a hollow-cylindrical sleeve having perforated sheet metal or a wire mesh, the grid or wire mesh electrode being connected to a reference potential and attached at one end thereof to a bottom plate of the insulator housing so as to form a concentric gap having a minimum width H between each of the high-voltage and protective electrodes and the grid or wire mesh electrode;

the grid or wire mesh electrode at least one of abutting and being received in a perforated nozzle plate, the perforated nozzle plate being at the electrical reference potential; and the grid or wire mesh electrode is circumferentially surrounded by a porous collector over a length not exceeding a length of the hollow-cylindrical sleeve, the aerosol flowing through the porous collector.

2. The electrostatic precipitator as recited in claim 1, wherein the high-voltage bushing extends from the surroundings through the insulator housing.

3. The electrostatic precipitator as recited in claim 2, wherein a pipe leads from the surroundings through the insulator housing to allow inflow of clean gas or clean air at a predetermined temperature and a predetermined pressure.

4. The electrostatic precipitator as recited in claim 3, wherein:

the insulator housing is disposed concentrically on the bottom plate which extends across a clear cross-sectional area of the precipitator housing;

the high-voltage insulator is centrally disposed in the insulator housing, and the high-voltage rod is fixed at one end in the high-voltage insulator; and the grid or wire mesh electrode is seated at one end portion in a passage of the bottom plate and at its other end portion in a nozzle of the perforated nozzle plate extending across the clear cross-sectional area of the precipitator housing.

5. The electrostatic precipitator as recited in claim 4, wherein the bottom plate is perforated between the insulator housing and a wall of the precipitator housing, the precipitator housing covering the perforated bottom plate and the insulator housing.

6. The electrostatic precipitator as recited in claim 5, further comprising a pre-filter disposed upstream of a free end face of the grid or wire mesh electrode and the perforated nozzle plate and extending across the clear cross-sectional area of the precipitator housing at an angle to an axis of the high-voltage rod, and wherein:

the raw gas inlet is disposed upstream of the pre-filter in a circumferential shell of the precipitator housing, and the clean gas outlet is disposed at an end of the precipitator housing which covers the bottom plate and the insulator housing.

7. The electrostatic precipitator as recited in claim 4, wherein the bottom plate is not perforated between the insulator housing and a wall of the precipitator housing, and forms a part of the wail of the precipitator housing at one end face.

8. The electrostatic precipitator as recited in claim 7, further comprising a pre-filter disposed upstream of a free end face of the grid or wire mesh electrode and the perforated nozzle plate and extending across the clear cross-sectional area of the precipitator housing at an angle to an axis of the high-voltage rod; and wherein:

the raw gas inlet is disposed upstream of the pre-filler in a circumferential shell of the precipitator housing, and the clean gas outlet is disposed downstream therein between the bottom plate and the perforated nozzle plate.

9. The electrostatic precipitator as recited in claim 3, wherein:

the insulator housing for the high-voltage insulator is disposed concentrically on the bottom plate which extends across a clear cross-sectional area of the precipitator housing;

the high-voltage insulator is disposed centrally on the bottom plate within the insulator housing and extends into the insulator housing;

an end of the high-voltage insulator extending into the insulator housing has disposed thereon a high-voltage grid with a plurality of high-voltage rods attached thereto in such a way that the high-voltage rods are uniformly distributed around a precipitator axis and equally radially spaced therefrom, each high-voltage rod extending coaxially into its respective grid or wire mesh electrode.

10. The electrostatic precipitator as recited in claim 9, wherein the bottom plate is perforated between the insulator housing and an inner wall of the precipitator housing.

11. The electrostatic precipitator as recited in claim 10, further comprising a pre-filter located upstream of a free end lace of a system of grid or wire mesh electrodes and the perforated nozzle plate and extending across the clear cross-sectional area of the precipitator housing at an angle to the axis of the precipitator.

12. The electrostatic precipitator as recited in claim 11, wherein a fixing plate is centrally attached to a side of the bottom plate that is opposite the high-voltage insulator, the grid or wire mesh electrodes extending through the fixing plate.

13. The electrostatic precipitator as recited in claim 3, wherein:

the insulator housing for the high-voltage insulator is disposed concentrically on the bottom plate which extends across a clear cross-sectional area of the precipitator housing;

the high-voltage insulator is centrally disposed on the bottom end face of the insulator housing, and the high-voltage rod is axially inserted in the high-voltage insulator;

one end face of the grid or wire mesh electrode begins at and extends from a central passage formed in the bottom plate and abuts at its other end face a centrally disposed end plate, which covers the grid or wire mesh electrode over and beyond its cross section;

the perforated nozzle plate is disposed between the end plate and the bottom plate, and the grid or wire mesh electrode is completely surrounded by the porous collector between the perforated nozzle plate and the end plate.

14. The electrostatic precipitator as recited in claim 13, wherein the raw gas inlet is disposed in the bottom plate, and the clean gas outlet is disposed in a wall of the precipitator housing in the area of the porous collector.

15. The electrostatic precipitator as recited in claim 3, wherein:

the insulator housing for the high-voltage insulator is disposed concentrically on the bottom plate which extends across a clear cross-sectional area of the precipitator housing;

the high-voltage insulator is centrally disposed on the bottom end face of the insulator housing;

an end of the high-voltage insulator extending into the insulator housing has disposed thereon a high-voltage grid with a plurality of high-voltage rods attached thereto in such a way that the high-voltage rods are uniformly distributed around a precipitator axis and equally radially spaced therefrom, each high-voltage rod extending coaxially into its respective grid or wire mesh electrode;

the grid or wire mesh electrodes being inserted in the bottom plate and abutting at their free end faces a covering end plate so as to extend through the perforated nozzle plate between the bottom plate and the end plate, the system of grid or wire mesh electrodes being completely surrounded by the porous collector between the nozzle plate and the covering end plate.

16. The electrostatic precipitator as recited in claim 15, wherein the raw gas inlet is disposed in the bottom plate and the clean gas outlet is disposed in a wall of the precipitator housing in the area of the porous collector.

* * * * *